US010272582B2

(12) United States Patent
Nazar et al.

(10) Patent No.: US 10,272,582 B2
(45) Date of Patent: Apr. 30, 2019

(54) HANDHELD BELT CUTTER

(71) Applicant: Laitram, L.L.C., Harahan, LA (US)

(72) Inventors: Gabriel Nazar, New Orleans, LA (US); Robert G. Guttenberg, Jefferson, LA (US)

(73) Assignee: Laitram, L.L.C., Harahan, LA (US)

( * ) Notice: Subject to any disclaimer, the term of this patent is extended or adjusted under 35 U.S.C. 154(b) by 230 days.

(21) Appl. No.: 14/683,592

(22) Filed: Apr. 10, 2015

(65) Prior Publication Data

US 2016/0297090 A1 Oct. 13, 2016

(51) Int. Cl.
*B26B 27/00* (2006.01)
*B26D 1/22* (2006.01)
*B26D 3/00* (2006.01)

(52) U.S. Cl.
CPC ..... *B26D 1/225* (2013.01); *B26B 27/00* (2013.01); *B26D 3/003* (2013.01)

(58) Field of Classification Search
CPC ..... B26D 1/025; B26D 1/22; B26D 1/225; B26D 1/02; B26D 3/003; B26B 27/00; B26B 27/005; B26B 27/002; B26B 27/007; B26B 29/06; B26B 29/00
USPC ..... 30/280, 314–317, 281–291, 294, 329, 30/332, 333, 337, 339, 293, DIG. 3; D8/98
See application file for complete search history.

(56) References Cited

U.S. PATENT DOCUMENTS 157,162 A * 11/1874 Duncan ..... A47L 13/08 30/169
693,660 A * 2/1902 Lamont ..... B26B 25/00 30/263
830,706 A * 9/1906 Fowler et al. ..... B26D 1/045 30/294
1,589,156 A * 6/1926 Hartman ..... B26B 5/005 30/293
1,737,552 A * 12/1929 Altman ..... A61F 15/02 30/293
2,601,183 A * 6/1952 Unsinger ..... B27G 17/025 30/283
2,679,098 A * 5/1954 Deicken ..... B43M 7/002 30/293

(Continued)

FOREIGN PATENT DOCUMENTS

JP 07-000269 U 1/1995
KR 20-1999-0016509 U 5/1999

OTHER PUBLICATIONS

User Instructions for Belt Cutter (100 & 150), copyright 2008, Flexible Steel Lacing Company, Grand Rapids, MI.

(Continued)

*Primary Examiner* — Evan H Macfarlane
(74) *Attorney, Agent, or Firm* — James T. Cronvich

(57) ABSTRACT

A belt cutter for cutting an end portion of a belt having regularly spaced ridges on one side. The belt cutter has a main body with a slot that receives the end portion of the belt. A blade extends from the main body into the slot. A deck having one or more grooves bounds one end of the slot. The grooves receive the belt's ridges and register the belt relative to the blade. A handle is provided to pull the cutter across the width of the belt in a direction parallel to the ridges for the blade to sever the end portion from the belt and form a new butt end parallel to the ridges.

23 Claims, 4 Drawing Sheets

(56) References Cited

U.S. PATENT DOCUMENTS 2,833,035 A * 5/1958 Butler ..... B28D 1/20 30/281
3,543,400 A * 12/1970 McPherson ..... A47G 27/0487 30/280
3,965,575 A * 6/1976 Stunger ..... B26B 5/00 30/294
5,044,081 A * 9/1991 Nguyen ..... B26B 5/005 30/289
5,085,449 A 2/1992 Hudson
5,499,565 A 3/1996 Hansen et al.
5,653,031 A 8/1997 Richter
5,848,471 A * 12/1998 Freeland ..... B26D 3/003 30/280
6,421,920 B1 * 7/2002 Jensen ..... A61B 17/122 30/124
6,745,476 B2 * 6/2004 Korba, Jr. ..... B26B 29/06 30/243
8,220,162 B2 7/2012 Rayner
8,495,818 B1 * 7/2013 Peppett ..... B26B 29/00 30/280
8,567,075 B2 * 10/2013 Hetts ..... B26B 5/005 30/287
8,661,723 B2 5/2014 Emde et al.
8,978,256 B1 * 3/2015 Loyer ..... B26B 29/06 30/280
9,415,521 B1 * 8/2016 Sliver ..... B26B 5/005
2004/0227022 A1 * 11/2004 Friedenbach ..... B26B 5/00 241/30
2005/0229403 A1 * 10/2005 Diaz ..... B26B 5/00 30/294
2011/0283546 A1 * 11/2011 Abreu ..... B26B 29/00 30/278
2015/0033477 A1 2/2015 Rubin et al.

OTHER PUBLICATIONS

Flexco Electric Belt Cutter brochure, copyright 2012, Flexible Steel Lacing Company, Downers Grove, IL.
Flexco 900 Series Belt Cutter brochure, copyright 2009, Flexible Steel Lacing Company, Downers Grove, IL.
Belt Cutters from Flexco brochure, copyright 2007, Flexible Steel Lacing Company, Downers Grove, IL.
Belt Skiving Increases Belt Life brochure, copyright 2003, Flexible Steel Lacing Company, Downers Grove, IL.
International Search Report and Written Opinion of the International Searching Authority, PCT/US2016/022076, dated May 6, 2016, Korean Intellectual Property Office, Daejeon, Republic of Korea.

* cited by examiner

HANDHELD BELT CUTTER

BACKGROUND

The invention relates to handheld cutting tools with a material-receiving opening and a material guide.

Belt cutters are used to cut belts to prescribed lengths and to make precisely oriented cuts at belt ends before they are welded together. Precise cuts are especially important in belts with regularly spaced drive teeth. If the cut line is not accurately positioned relative to the teeth, the tooth spacing across the welded cut ends will not match the regular tooth spacing, or pitch, of the belt. One common way of cutting a belt, including a toothed belt, is by running a knife blade along a straight edge lain across the width of the belt. But imprecise placement of the straight edge and uneven drawing of the knife along the straight edge affect the precision of the cut. And when a straight edge is used, the belt normally has to be supported from below.

SUMMARY

One version of a belt cutter embodying features of the invention comprises a main body with a slot for receiving an end portion of a belt having regularly spaced ridges on one side that extend across the width of the belt. A blade extends from the main body into the slot. A guide bounds one side of the slot and has one or more grooves for receiving one or more of the ridges of the belt and registering the belt relative to the blade. A handle is used to pull the main body across the width of the belt in a direction parallel to the ridges for the blade to cut through the end portion of the belt and form a butt end parallel to the ridges.

Another version of such a belt cutter comprises a blade mounting block having an outer side and an opposite inner side and a blade recess. A blade received in the blade recess has a cutting edge that extends outward of the inner side of the blade mounting block. A removable blade mounting plate attached to the blade mounting block retains the blade in the recess. A deck plate faces the inner side of the blade mounting block across a gap. A guide is mounted on the guide plate in the gap and forms a slot with the inner side of the blade mounting block for receiving an end portion of a belt having regularly spaced ridges on one side that extend across the width of the belt. The cutting edge of the blade extends into the slot, and the guide has one or more grooves for receiving one or more of the ridges of the belt in the slot and registering the belt relative to the cutting edge of the blade. A handle is used to pull the belt cutter across the width of the belt in a direction parallel to the ridges for the cutting edge of the blade to cut through the end portion of the belt and form a butt end parallel to the ridges.

DETAILED DESCRIPTION

Figure 1:
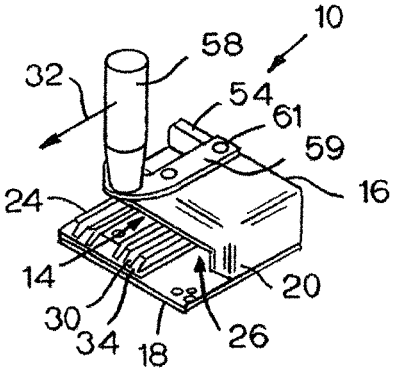
FIG. 1 is an isometric view of a handheld belt cutter embodying features of the invention.

As used in this specification, each of the pairs of terms, upper and lower, top and bottom, and ceiling and floor, are interchangeable and replaceable by terms such as left and right, first side and second side, and first wall and second wall. They are used only in relation to the orientation of the figures on the drawing sheets to help describe the features of the belt cutters described in detail.

Figure 2:
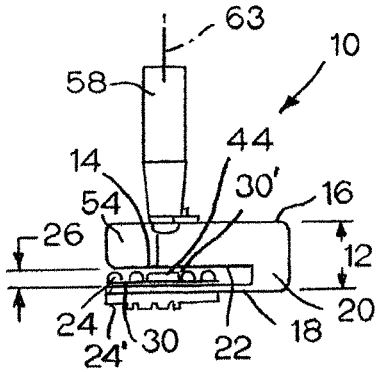
FIG. 2 is a side elevation view of the belt cutter of FIG. 1.
Figure 3:
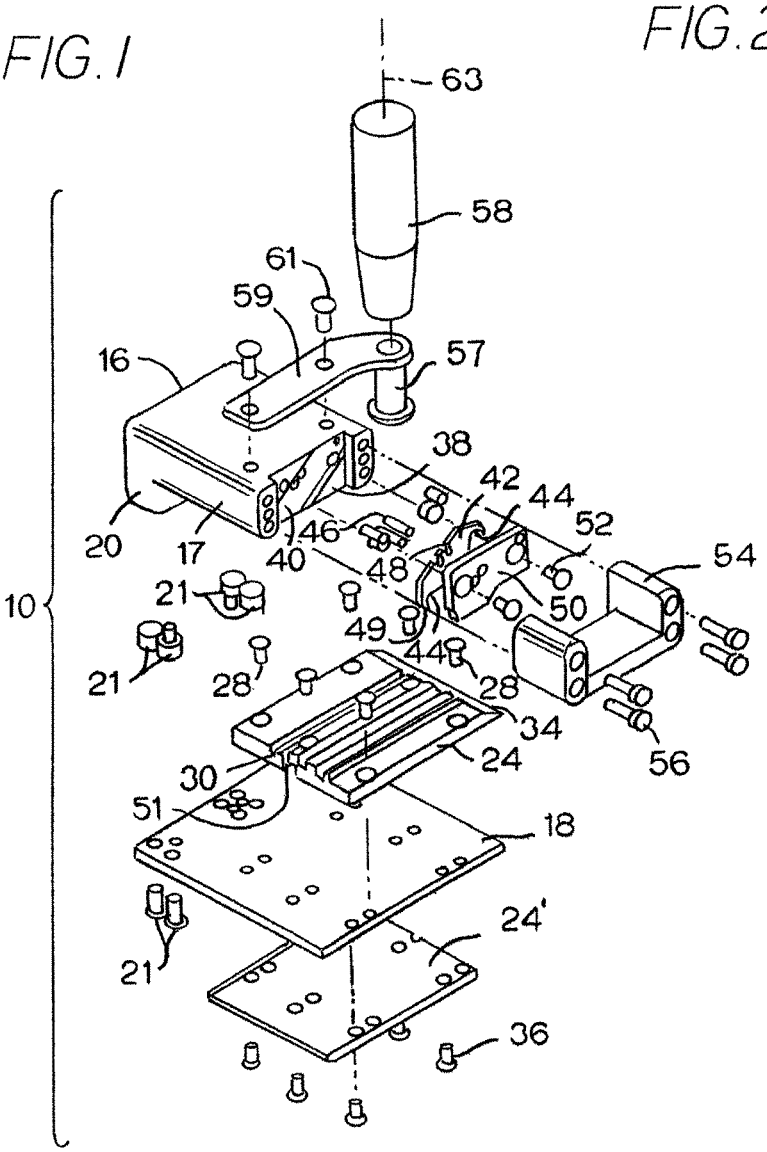
FIG. 3 is an exploded isometric view of the belt cutter of FIG. 1.

A handheld belt cutter embodying features of the invention is shown in FIGS. 1-3. The belt cutter 10 has a main body 12 that forms a slot 14 for receiving an end portion of a belt to be cut. The main body includes a blade mounting block 16 fastened to one end of a deck or guide plate 18. The blade mounting block 16 is L-shaped with a depending leg 20 attached to the deck plate 18 by fastening hardware 21. The leg 20 closes the slot 14 along one side. The portion 17 of the blade mounting block 16 cantilevered over the slot 14 extends from the leg 20 and forms a ceiling 22 bounding the slot. The deck plate 18 is spaced apart from the slot's ceiling 22 by a gap 26. A guide deck 24 is fastened to the top of the deck plate in the gap 26. The top of the deck 24 and the ceiling 22 of the blade mounting block 16 bound the slot 14. The ceiling 22 can be lined with low-friction tape, such as tape sold under the TEFLON® brand name, for low-friction sliding contact with a belt pulled through the slot 14.

The deck 24, which is attached to the deck plate 18 by screws 28, has parallel grooves 30 in its outer face. Although shown with multiple grooves 30, the deck could be made with a single groove. The depth and width of the grooves 30 are sized to receive ridges, such as drive teeth or drive bars, that extend across the width of a belt to be cut. The grooves 30 extend across the deck in a pull direction 32. The leading edge 34 of the deck is ramped to help guide the belt edge into the slot 14. If the deck 24 has more than one groove 30, those grooves are spaced apart by the pitch of the belt or an integral multiple of the pitch. The guide deck 24 could also have a second set of grooves 30' offset from the first set of grooves 30 and having the same or different width and depth dimensions to accommodate belts with a different pitch. A spare or alternate grooved deck 24' may be attached to the bottom side of the deck plate 18 by screws 36 for convenience. Both decks 24, 24' are readily detached for exchange or replacement.

The blade mounting block 16 has an outer recess 38 formed at the end of the cantilevered portion 17. A blade recess 40 is recessed even deeper into the end of the cantilevered portion 17. The blade recess 40 opens into the outer recess 38 and is diagonally disposed to receive a blade 42 with cutting edges 44 at each end. The blade 42 is accurately positioned in the blade recess 40 by positioning pins 46 and blade notches 48. The blade 42 is reversible and may be reversed when one of the cutting edges 44 becomes too dull. The cutting edge 44 at the lower end protrudes outward of the blade mounting block 16 into and across the slot 14. The cutting edge 44 of the blade 42 is shown as curved, but a straight blade received in a blade recess shaped to the straight blade and positioned 4 appropriately placed position pins and blade notches could be used instead. The blade 42 shown is curved concavely with a hooked end 49. The blade 42 is retained snugly in the blade recess 40 by a blade mounting plate 50 that resides in the outer recess 38. The hooked end 49 of the blade 42 is precisely positioned relative to the grooves 30 in a slit 51 in the end of the deck 24. Screws 52 fasten the blade mounting plate 50 to the blade mounting block 16. The main body 12 also includes a U-shaped blade access bracket 54 that forms an extension of the cantilevered portion 17 and the ceiling 22, but allows access to the blade mounting plate 50 between the legs of the U for easy blade exchange or replacement. The blade access bracket 54 is fastened to the blade mounting block by bolts or screws 56.

A handle 58—in this example, a single-post handle—is fastened to one end of a handle bracket 59 by a bolt 57. The bracket 59 is fastened to the top of the blade mounting block 16 by screws 61. The handle 58 is cantilevered by the bracket 59 outward of the blade support block 16 and hangs over an exposed portion of the deck 24 and the deck mounting plate 18, which has a larger footprint than the cantilevered portion 17 of the blade mounting block 16. The axis 63 of the single-post handle 58 is generally perpendicular to the plane of the guide deck 24 and is offset from the cutting edge 44 of the blade 42 in the pull direction 32.

Figure 4:
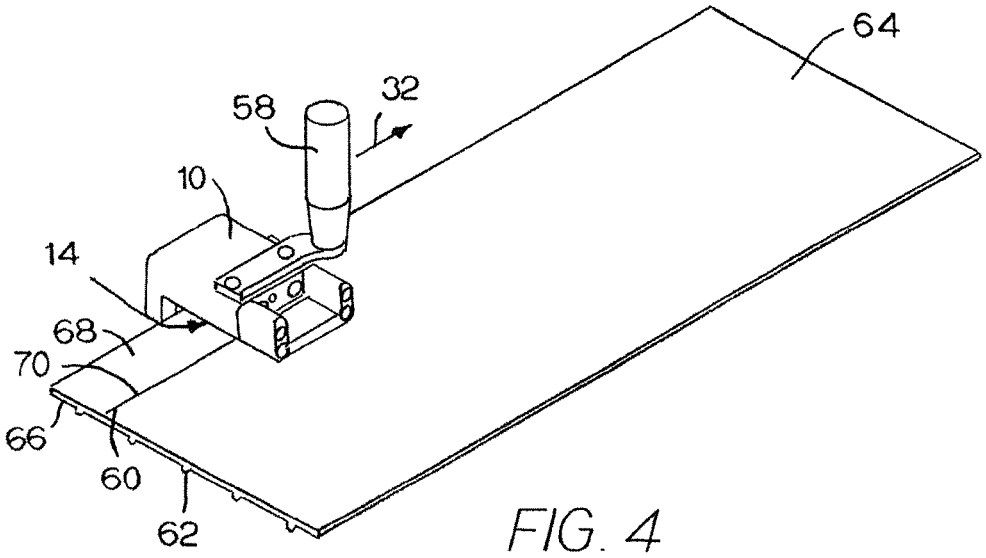
FIG. 4 is an isometric view showing the belt cutter of FIG. 1 cutting a toothed conveyor belt as viewed from above the belt.
Figure 5:
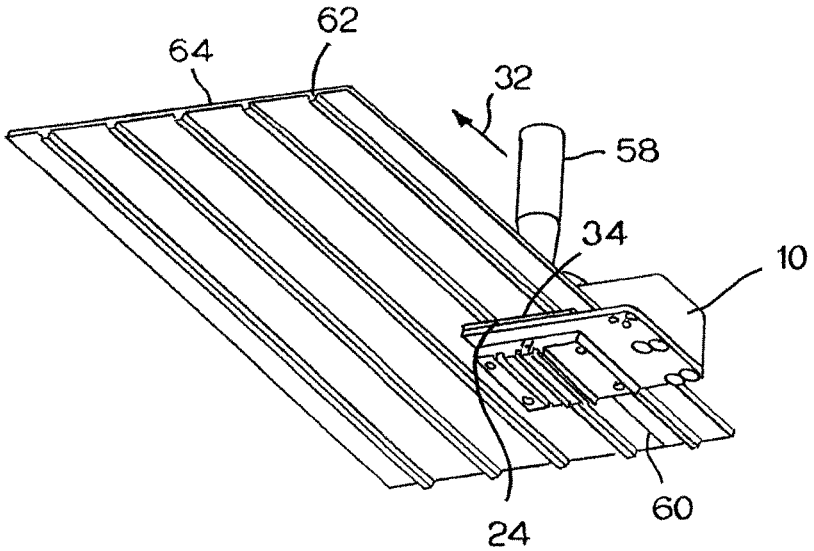
FIG. 5 is an isometric view showing the belt cutter of FIG. 1 cutting a toothed conveyor belt as viewed from below the belt.

The blade mounting block 16, the deck plate 18, and the deck 24 are precision-machined to precisely register the belt to be cut to the blade's cutting face 44 in the slot 14 and produce a straight cut 60 between the teeth, or ridges 62, in a belt 64, as shown in FIGS. 4 and 5. With the blade 42 positioned laterally midway between two consecutive belt-specific grooves 30 in the deck 24, as shown in FIG. 2, the cut will be made midway between the consecutive ridges. But if the grooves 30 are laterally offset relative to the blade 42 the cut will lie closer to one of two consecutive belt ridges 62 than to the other. To cut a belt 64 across its width, a human operator first positions the cutter 10 off the belt adjacent a side 66 at which the cut 60 will start. Pulling the cutter 10 by the handle 58 in the pull direction 32, the operator aligns the grooves in the deck with the ridge or ridges 62 at or near the end portion 68 to be cut from the belt. The ramped leading edge 34 of the deck 24 helps feed the belt 64 into the cutter's slot 14. The operator continues to pull the cutter 10 along the end portion 68 in the pull direction parallel to the ridges 62. The grooves receive and register the belt ridges 62 to guide the belt through the slot 14. The close tolerance between the belt ridges 62 and the cutter's grooves ensures a straight, precise cut 60 across the width of the belt 64 without the use of a separate straight edge and without requiring a bottom support for the belt. The resulting new belt butt end 70 is straight and precisely positioned parallel to the ridges 62.

Figure 6:
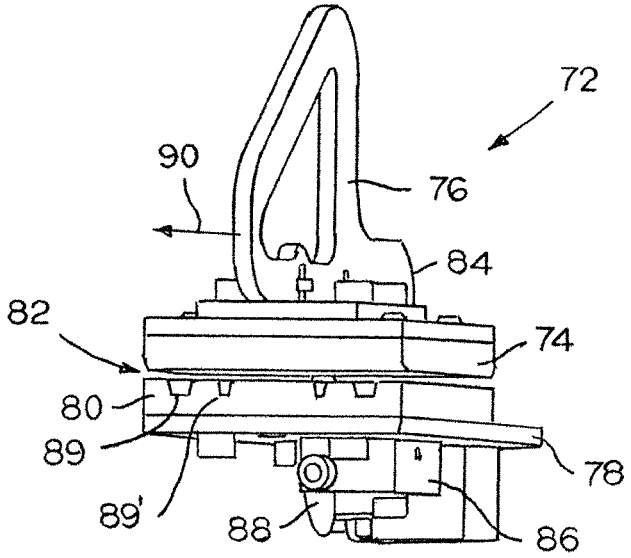
FIG. 6 is an isometric view of a second version of a belt cutter embodying features of the invention.

Another version of a belt cutter is shown in FIG. 6. The cutter 72 has an upper block 74 to which a handle 76 is attached. A lower deck plate 78 supports a grooved guide deck 80 across a belt-edge-receiving slot 82 from the upper block 74. The lower deck plate 78 and the upper block 74 are held in registration by a spine 84. In this version the spine 84 is integral with the handle 76. On the bottom side of the deck plate 78, a blade mounting block 86 retains a blade 88 in place on the same side of the slot 82 as the deck. The blade extends through a slit in the deck plate 78 and the deck 80 and into the slot 82. In this example the blade 88 is a rotatable circular blade, but it could be a fixed straight or curved blade. Ridges in a belt to be cut are aligned with the corresponding grooves 89, 89' in the guide deck 80. Then the belt cutter 72, guided by the belt's ridges in the grooves, is pulled across the belt in the pull direction 90 to cut through the belt parallel to the ridges. The blade 88 is generally aligned with the spine 84 in the pull direction 90 so that the spine doesn't interfere with the belt while it is being cut.

Figure 7:
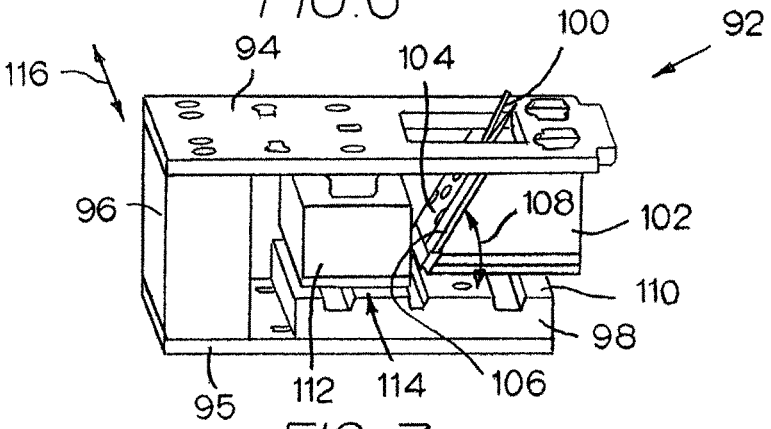
FIG. 7 is an isometric view of a third version of a belt cutter embodying features of the invention.

The belt cutter 92 in FIG. 7 has an upper plate 94 joined to a parallel lower deck plate 95 by a side post 96. A grooved guide deck 98 is mounted to the deck plate 95. A pair of back-to-back blades 100 are clamped to a blade mounting block 102 by a blade clamp 104. The blade mounting block is suspended from the bottom side of the upper plate 94. In this example, the blade mounting block 102 has a beveled face 106 positioning the blades 100 at an oblique angle 108 to the upper face 110 of the deck 98 to form a beveled cut in the belt edge. Of course, the beveled face 106 of the blade mounting block 102 could be vertical to position the blades 100 to form an unbeveled cut in the belt edge. A belt retainer block 112 is suspended from the upper plate 94 on the opposite side of the blade from the blade mounting block 102. The bottom surfaces of the belt retainer block 112 and the blade mounting block 102 form a ceiling on the opposite side of the belt slot 114 from the deck 98. The back-to-back blades 100 allow the belt cutter 92 to be pulled in either direction 116 by a handle (not shown).

Figure 8:
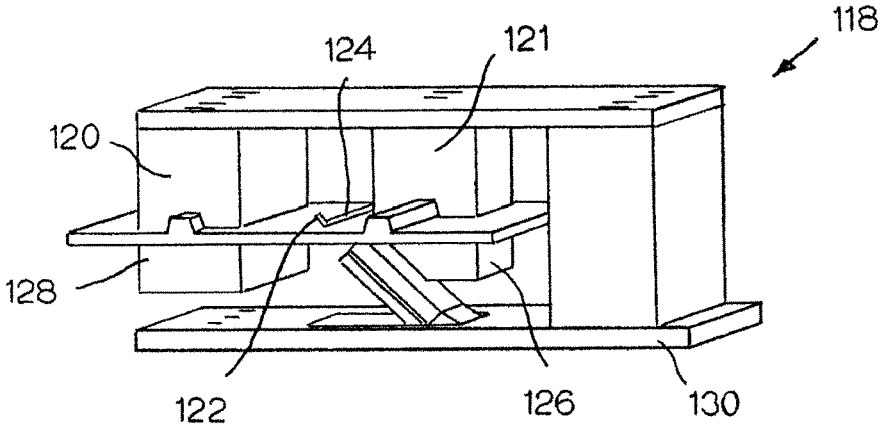
FIG. 8 is an isometric view of a fourth version of a belt cutter embodying features of the invention.

The belt cutter 118 of FIG. 8 is generally an upside-down version of the belt cutter 92 of FIG. 7. One difference is that the continuous grooved deck 98 of FIG. 7 is replaced by a pair of grooved guide blocks 120, 121 flanking the cutting edge of the blade 122 in a slot between the guide blocks 120, 121 on one side and a blade mounting block 126 and a belt retainer block 128 on the other side. The blade mounting block 126 and the belt retainer block 128, which are shown partly cut away in FIG. 8, are mounted to a lower plate 130. The angled blade 122 makes a beveled cut 124 in a belt.

Figure 9:
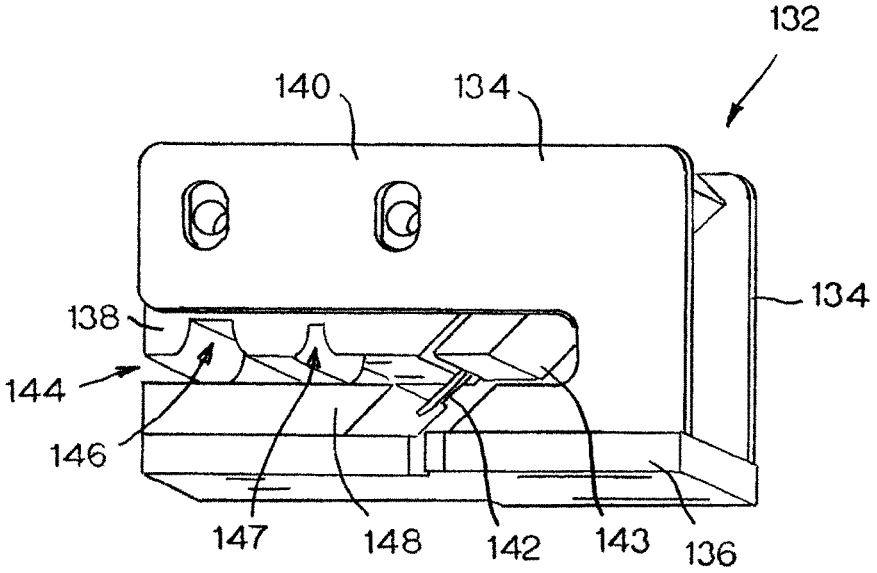
FIG. 9 is an isometric view of a fifth version of a belt cutter embodying features of the invention.

In the belt cutter 132 of FIG. 9, a pair of J-shaped brackets 134 are mounted to a lower plate 136. A grooved guide deck 138 is supported between shank portions 140 of the two J-shaped brackets 134. A blade 142, retained between the deck 138 and a blade mounting block 143, extends obliquely downward through a belt-receiving slot 144. Unlike the grooved decks in the other versions, the guide deck 138 in FIG. 9 is not bisected by the blade 142. Rather, the grooves 146, 147 reside on only one side of the blade. A belt retainer deck 148 is mounted on the lower plate 136 across the slot 144 from the guide deck 138. The ends of the guide deck 138, the blade mounting block 143, and the belt retainer deck 148 are beveled to match the oblique angle of the blade 142. Of course, the beveling can be replaced with right-angle geometry for cuts through the belt perpendicular to the belt plane.

Figure 10:
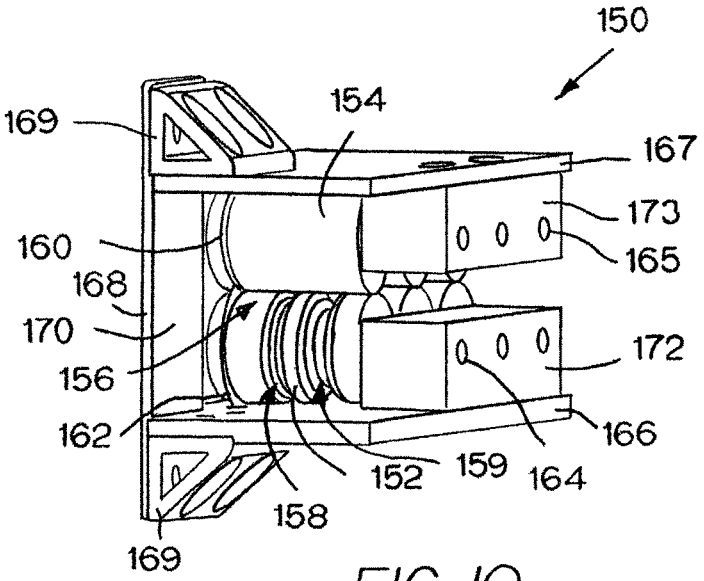
FIG. 10 is an isometric view of a sixth version of a belt cutter embodying features of the invention.

Instead of guide decks and belt retainer blocks, the belt cutter 150 in FIG. 10 has three sets of guide rollers 152 and belt retainer rollers 154 defining a belt-receiving slot 156. The guide rollers 152 have grooves 158, 159 receiving belt ridges to guide the belt through the cutter 150. One of the belt retainer rollers 154 has a narrow circumferential slit 160 to receive the cutting edge of a circular blade 162 that is mounted coaxially with one of the guide roller 152 on a roller shaft 164. The guide rollers 152 are mounted to a lower plate 166, and the belt retainer rollers 154 are mounted to an upper plate 167. The two parallel plates are joined at one end by a bridge plate 168 and gussets 169. An inner shaft support block 170 mounted to the bridge plate 168 and outer shaft support blocks 172, 173 mounted to the lower and upper plates 166, 167 support the ends of the guide roller shafts 164 and belt retainer roller shafts 165. A fixed curved or straight blade could be used instead of the rotatable circular blade 162. Its cutting edge could be positioned in the slot 156 at the position of the circular blade 162 or positioned at a more central location. Like the belt cutters in FIGS. 7-9, the belt cutter 150 in FIG. 10 is shown without a handle to simplify the drawings.

What is claimed is:

1. A belt cutter comprising:

a main body forming a first side of a slot for receiving an end portion of a belt having regularly spaced ridges on one side that extend across a width of the belt, wherein the slot has a closed end and three open ends, the three opens ends including an outer open end opposite the closed end, and the three open ends including a first open side end and a second open side end opposing the first open side end, the first and second open side ends extending from the outer open end to the closed end;

a blade extending from the main body into the slot;

a guide bounding an opposite second side of the slot and stationarily affixed to the main body to fix the size of the slot, the guide having an outer face into which a plurality of grooves opening into the slot are recessed at positions laterally offset from the blade, each groove having a depth and a width sized to receive and register one or more of the ridges of the belt with the grooves to guide the belt relative to the blade, the grooves extending from the first open side end to the second open side end;

wherein at least a portion of the blade resides in the slot between the closed end of the slot and at least one of the plurality of grooves and extends across the entire slot;

a handle for moving the main body across the width of the belt in a direction parallel to the ridges guided by the plurality of grooves for the blade to cut through the end portion of the belt and form a butt end parallel to the ridges; and wherein the blade has a cutting edge extending from the first side of the slot to the second side of the slot.

2. A belt cutter as in claim 1 wherein the cutting edge is a curved cutting edge.

3. A belt cutter as in claim 1 wherein the blade is reversible end to end.

4. A belt cutter as in claim 1 wherein the blade is supported on the first side of the slot.

5. A belt cutter as in claim 1 wherein the blade is angled oblique to a plane of the belt when positioned in the slot to produce a beveled cut.

6. A belt cutter as in claim 1 wherein the guide is a grooved plate.

7. A belt cutter as in claim 1 wherein the blade is supported on the second side of the slot.

8. A belt cutter as in claim 1 wherein the main body has an upper portion forming the first side of the slot and a lower portion supporting the guide across the slot from the first side.

9. A belt cutter as in claim 1 wherein the main body has an upper portion from which the blade extends into the slot and a lower deck plate supporting the guide across the slot from the upper portion.

10. A belt cutter as in claim 9 further comprising an alternate guide removably attached to a side of the deck plate opposite the guide bounding the slot.

11. A belt cutter as in claim 1 wherein the handle is a single-post handle attached to the main body and having an axis perpendicular to a plane of the guide.

12. A belt cutter as in claim 1 wherein the guide has a ramped leading edge in a pull direction to guide the end portion of the belt into the slot.

13. A belt cutter comprising:

a blade mounting block having an outer side and an opposite inner side and a blade recess;

a blade received in the blade recess and having a cutting edge extending outward of the inner side of the blade mounting block;

a blade mounting plate removably attached to the blade mounting block to retain the blade in the recess;

a deck plate facing the inner side of the blade mounting block across a gap;

a deck stationarily mounted on the deck plate in the gap and forming a fixed-size slot with the inner side of the blade mounting block for receiving an end portion of a belt having regularly spaced ridges on one side that extend across a width of the belt, wherein the slot has a closed end;

wherein the cutting edge of the blade extends into and across the entire slot and the deck has an outer face into which one or more grooves opening into the slot are recessed at positions laterally offset from the blade, each groove having a depth and a width sized to receive and register one or more of the ridges of the belt in the slot with the one or more grooves to guide the belt relative to the cutting edge of the blade;

wherein the cutting edge of the blade resides between the closed end of the slot and at least one of the one or more grooves;

a handle for moving the belt cutter across the width of the belt in a direction parallel to the ridges guided by the one or more grooves for the cutting edge of the blade to cut through the end portion of the belt and form a butt end parallel to the ridges.

14. A belt cutter as in claim 13 wherein the handle is a single-post handle attached to the blade mounting block and having an axis perpendicular to a plane of the deck.

15. A belt cutter as in claim 13 wherein the deck has a ramped leading edge in a pull direction to guide the end portion of the belt into the slot.

16. A belt cutter as in claim 13 further comprising a blade access bracket retaining the blade mounting plate to the blade mounting block.

17. A belt cutter as in claim 13 wherein the blade mounting block has a depending arm portion at one end fastened to a side edge of the deck plate.

18. A belt cutter as in claim 13 wherein the cutting edge of the blade is curved.

19. A belt cutter as in claim 13 wherein the blade is reversible end to end.

20. A belt cutter as in claim 13 wherein the blade is angled oblique to a plane of the belt when positioned in the slot to produce a beveled cut.

21. A belt cutter as in claim 13 wherein the blade is supported on an other side of the slot from the deck.

22. A belt cutter as in claim 13 wherein the blade is supported on a same side of the slot as the deck.

23. A belt cutter as in claim 13 further comprising an alternate deck removably attached to a side of the deck plate opposite the deck bounding the slot.

* * * * *